US006908020B2

(12) United States Patent
Gravert

(10) Patent No.: US 6,908,020 B2
(45) Date of Patent: Jun. 21, 2005

(54) DEVICE FOR SEPARATING STRIPS AND USES OF SUCH A DEVICE

(75) Inventor: Peter Gravert, Enzesfeld-Lindabrunn (AT)

(73) Assignee: Sundwig GmbH, Hemer (DE)

( * ) Notice: Subject to any disclaimer, the term of this patent is extended or adjusted under 35 U.S.C. 154(b) by 0 days.

(21) Appl. No.: 10/149,323

(22) PCT Filed: Dec. 9, 2000

(86) PCT No.: PCT/EP00/12474

§ 371 (c)(1),
(2), (4) Date: Aug. 29, 2002

(87) PCT Pub. No.: WO01/42115

PCT Pub. Date: Jun. 14, 2001

(65) Prior Publication Data

US 2003/0146258 A1 Aug. 7, 2003

(30) Foreign Application Priority Data

Dec. 9, 1999 (DE) ..... 199 59 333

(51) Int. Cl.[7] ..... B65H 20/02; B65H 23/04

(52) U.S. Cl. ..... 226/109; 242/548; 242/615.21; 242/530.1; 83/102; 83/107

(58) Field of Search ..... 226/109, 185; 242/530.1, 530.3, 615.21, 548; 83/102, 107, 425.3, 425.4, 508.3, 500, 501–503, 675

(56) References Cited

U.S. PATENT DOCUMENTS 595,092 A * 12/1897 Bosley ..... 83/102
1,939,246 A * 12/1933 Antonsen ..... 225/3
2,717,037 A * 9/1955 Goodwillie ..... 242/530.1
3,359,842 A * 12/1967 Young ..... 83/500
3,771,398 A * 11/1973 Schaefer et al. ..... 83/500
3,847,319 A * 11/1974 Brandon et al. ..... 226/109
3,939,745 A * 2/1976 Weeks et al. ..... 83/425.3
4,040,574 A * 8/1977 Johnson ..... 242/530.1
4,566,162 A * 1/1986 Brands ..... 242/548
5,727,724 A * 3/1998 Dowling ..... 226/185
6,082,660 A * 7/2000 Meyer ..... 242/548

FOREIGN PATENT DOCUMENTS

| | | |
|---|---|---|
| DE | 305092 | * 11/1919 |
| DE | 1 088 798 | 9/1954 |
| DE | 2 138 088 | 5/1973 |
| DE | 3405676 | 6/1985 |
| DE | 3820997 | 12/1989 |
| FR | 2474006 | 7/1981 |
| GB | 2 219 992 A | 12/1989 |

* cited by examiner

*Primary Examiner*—John M. Jillions
(74) *Attorney, Agent, or Firm*—Proskauer Rose LLP

(57) ABSTRACT

A device for isolating strips conveyed next to another in lengthwise direction is constituted by at least one separating unit which is extended parallel to a lengthwise axis. Each strip is assigned to one guide and it is inserted and guided by the guides in a plane running essentially parallel to the lengthwise axis of the separating unit and different for neighboring guides. When the strips are inserted into the guides, the guides are adjustable from a starting position, in which the strips have a slight lateral interval, into a separable position, in which a larger interval exists between the strips.

16 Claims, 4 Drawing Sheets

DEVICE FOR SEPARATING STRIPS AND USES OF SUCH A DEVICE

BACKGROUND OF THE INVENTION

The present invention relates to a device for isolating strips, particularly metal strips, conveyed next to one another in their lengthwise direction. These types of devices are used in order to produce a defined horizontal interval between the strips, with which the strips may be fed to further processing. In this way, damage of the strip edges is avoided, which otherwise could be caused by contact between the strips conveyed next one another.

The isolation has particularly significance in the production and processing of metal strips, which are obtained, for example, from a wide metal band by slitting using slitting shears and are subsequently coiled into isolating coils in a coiling device. These types of strips made of metal have a high intrinsic stiffness transverse to the direction of conveyance even if they have a slight thickness. On the one hand, this intrinsic stiffness makes the production of an interval between the individual strips transverse to the direction of conveyance more difficult. On the other hand, due to the intrinsic stiffness of the strips, even slight contacts between the strips may lead to significant damage.

The separation of metal strips is made more difficult if the isolation of the strips is to occur a short distance after the slitting shears. In this case, which occurs frequently due to the overall space available, which is often restricted in practice, the strips which are still connected to the uncut sheet endeavor, due to their intrinsic stiffness, to maintain their original direction of conveyance, so that greater forces have to be applied for the separation.

If, in contrast, the isolation is first performed at a large distance from the slitting shears, the connection to the still uncut sheet does not have such a strong effect. Instead, the danger arises that the strips will run uncontrolled out of the intended direction of conveyance.

In practice, separating devices whose guideways are delimited by separation disks which are fixed in their position are used as a rule. The strips are typically laid by hand into these guideways. Alternatively, isolating the strips through a mechanically-generated, back and forth shaking movement of a separating shaft has also been attempted.

Manual isolation, particularly in the separation of strips made of metal, not only requires great bodily exertion, but also has the danger of injuries. In mechanically-supported isolation, it has been shown that the isolation result of the mechanical back-and-forth movement of the strips is so unreliable that the position of the strips must be corrected by hand. The latter particularly applies for large band thicknesses, in which the intrinsic stiffness of the metallic strips is particularly noticeable.

A device for a separating the front ends of strips produced from a metal band by slitting is known from German Published Application 21 38 088, in which the isolation of the strips is performed using an automatically operating isolating unit. For this purpose, the isolating unit is equipped with clamping devices which are displaceable on a joint axis, to each of which one strip front end is assigned. After the strip front ends are clamped in the clamping devices, the clamping devices are simultaneously displaced on the axis, so that the strip front ends are spread apart from one another like a fan. The movement of the clamping devices along the axis is coordinated in this case via threads having different pitch in such a way that all strip front ends reach their separated positions simultaneously.

The advantage of the known device described above is that it allows automated isolating of the strips within a short operating interval. However, it is disadvantageous that for this purpose a significant constructive outlay is necessary, particularly for the clamping devices. In addition, as a rule the strip front ends may only be laid in the clamping devices when the device is at a standstill. In addition, the known device requires a significant amount of space, which in many cases may only be made available with difficulty.

SUMMARY OF THE INVENTION

The object of the present invention is to provide an isolating device of the type described above which is constructed simply and allows reliable, time-saving isolation of the strips. In addition, advantageous uses of such a device are to be indicated.

This object is achieved by a device for isolating strips, particularly metal strips, conveyed next one another in their lengthwise direction, having at least one separating unit extending in an axial direction, in which each strip is assigned one guide, each of which guides one of the strips, which are positively inserted into them, in a different plane running essentially parallel to the lengthwise axis of the separating unit than each of the guides positioned neighboring it, the guides, when strips are inserted in them, in addition to having a starting position, in which the strips have a slight lateral interval, being adjustable into a separating position, in which there is a greater lateral interval between the strips.

In a device implemented according to the present invention, it is no longer necessary to clamp the strips into the separating unit for the isolating procedure. Instead, the strips are positively guided in guides. Simultaneously, the guides are implemented in such a way that strips positioned neighboring one another each lie in different planes. In this way, lateral contact of the strips and the danger of damage accompanying this is avoided from the outset. In addition, the guides are adjustably implemented in such a way that the strips may be brought from a starting position, in which they have a slight lateral interval in relation to a plane running parallel to the lengthwise axis of the separating device, into a separating position, in which this interval is increased to the size necessary for further processing. At the same time, the guides hold the respective strips lying in them so tightly enclosed that they are reliably positively guided, at least on their edge regions.

The positive guiding of each of the strips in a different plane which is provided according to the present invention allows, at the same time, the strips to be held loosely in the guides of the separating unit without the effect of clamping forces. In this way, the front ends of the strips may be pushed into the separating unit without the production cycle having to be interrupted. Thus, during the processing of strips made of metal, bringing the slitting shears to a standstill for inserting and clamping the strip front ends in the separating device is no longer necessary.

A further essential advantage of the embodiment of a separating device according to the present invention is that high lateral forces may be applied via the guides onto the strip front ends loosely inserted in them during the separating procedure performed by the adjustment of the guides. In this way, the present invention also allows reliable isolating of metal strips which have a greater thickness and high intrinsic stiffness.

In practice, the present invention may be implemented simply if two planes are provided, in each of which strips are guided, and one of the guides at a time guides the strip assigned to it in one plane, while the guide closest neighboring this guide in the axial direction of the separating unit guides the strip assigned to it in the respective other plane. In a device designed in this way, two different conveyor planes are selected, to which the strips, viewed transverse to their direction of conveyance, are each assigned in alternating sequence. This allows reliable separation of the strips to be performed in a simple construction of the device.

According to a further embodiment of the present invention, the separating unit may include two rotatably mounted shafts having their axes positioned in parallel, between which the strips are guided, the guides for the strips being implemented on the respective shafts and running around the circumference of the shafts. In this embodiment, the circumferential surfaces of one shaft each form a cover of the open side of the guides implemented on the respective other shafts. In this way, a guide gap is formed for each strip between the shafts, in which the strips are reliably guided. The danger of the strips breaking out of the guides due to twisting or similar things is therefore excluded.

In this context, it is particularly advantageous if the guides are implemented like sections of thread, each having a pitch, and the shafts are driven in opposite directions. In a device according to the present invention designed in this way, the strips may be moved into their isolating positions by rotation of the shafts and/or the respective guides assigned to them. It is particularly advantageous in this regard if, starting from a first guide having the smallest pitch, the pitch of each following guide in the axial direction of the shafts is greater than the pitch of the closest neighboring guide to it in the direction of the first guide. This allows the strips to be brought, according to the pitch of the respective guide assigned to them, from a starting position to their final isolating position using one single rotational movement of the shafts. In this case, because the pitches of the successive guides in the axial direction of the shafts each increase in relation to the one preceding, consideration is given to the circumstance that the amount by which the strips are each displaced from the non-separated position transverse to their direction of conveyance must also increase with increasing distance of the strips concerned from the strip displaced least, which is selected as a reference point, in order to obtain a uniform interval of the strips upon termination of the separation.

An advantageous variant of the present invention is characterized in that the guides of the separating unit are implemented on isolating segments. In this embodiment, the strips are brought in guides, from the starting position into the separated position by elements which are positionable independently from one another. In this case, the guides present on the isolating segments are again implemented in such a way that the strips positioned neighboring one another are each conveyed into different planes.

An expedient alternative for using rotationally operated shafts in this contexts is that the isolating segments are implemented in the form of sliding blocks and are movably guided in the axial direction of the separating unit. The particular advantage of the use of the sliding blocks guided in this way is that relative movements between the strips and the contact surface of the respective guide assigned to them during the separating procedure may be largely avoided. Large adjustment paths may be made possible with simultaneously simplified construction and a low space requirement of the drives required for the adjustment if the isolating elements are distributed onto different guideways.

In addition, it is expedient if the separating unit has a first operating position, in which the strips lie loosely in their guides, and a second operating position, in which the strips are clamped in the guides. This embodiment of the present invention allows the strip front ends to be pushed loosely into the separating device without loss of time and subsequently to be clamped in the guides. This is advantageous, for example, if the separating device according to the present invention may travel from an initial position, in which the strip front ends are pushed in, into a transfer position, in which the strips are, for example, transferred to a coiling device. The loose strip front ends, which are positively guided only during the pushing-in procedure, may be reliably fed to further processing in this way, it also being possible to perform the separation during the transfer procedure.

The danger of damage to the strips, particularly to their edges, may be avoided if the free edges of the guides are rounded or flattened, at least in the region in which they come into contact with the strips. If the guides are implemented as thread sections, it is favorable if the angle of the rounding or flattening is adjusted to the respective pitch of the thread section in such a way that an essentially exclusively linear contact between the strips and the free edges occurs. By dimensioning the free edges in this way, damage to the strip edge or surface by edges of the guides which cut into the strips may be reliable avoided.

The present invention allows safe, reliable isolation of strips with a low outlay for apparatus and little building material. At the same time, a device according to the present invention is, due to the simplicity of the construction of the separating unit, particularly suitable for automatic adjustment to various operating conditions, such as those which occur, for example, upon a change of the widths of the strips to be processed.

A first advantageous use of a device according to the present invention is for such a device to be in the outlet of a device for slitting a band, particularly a metal band, into multiple strips conveyed next one another in the lengthwise direction. In this case, depending on the construction conditions and the requirements which result from the type of further processing of the strips, the isolating device may be positioned stationary. It may also be expedient, however, if the device for isolating the strips may travel from a transfer position, in which it accepts the strips to be isolated, into an isolating position, in which the isolating of the strips occurs.

Furthermore, a device according to the present invention may also be advantageously used for transporting strips, particularly metal strips, using which the strips are transported from a device in which the strips are produced by slitting a band to a device in which further processing of the strips occurs.

BRIEF DESCRIPTION OF THE DRAWING

In the following, the invention is described in more detailed with reference to a drawing illustrating an exemplary embodiment.

DETAILED DESCRIPTION OF THE INVENTION

Figure 3:
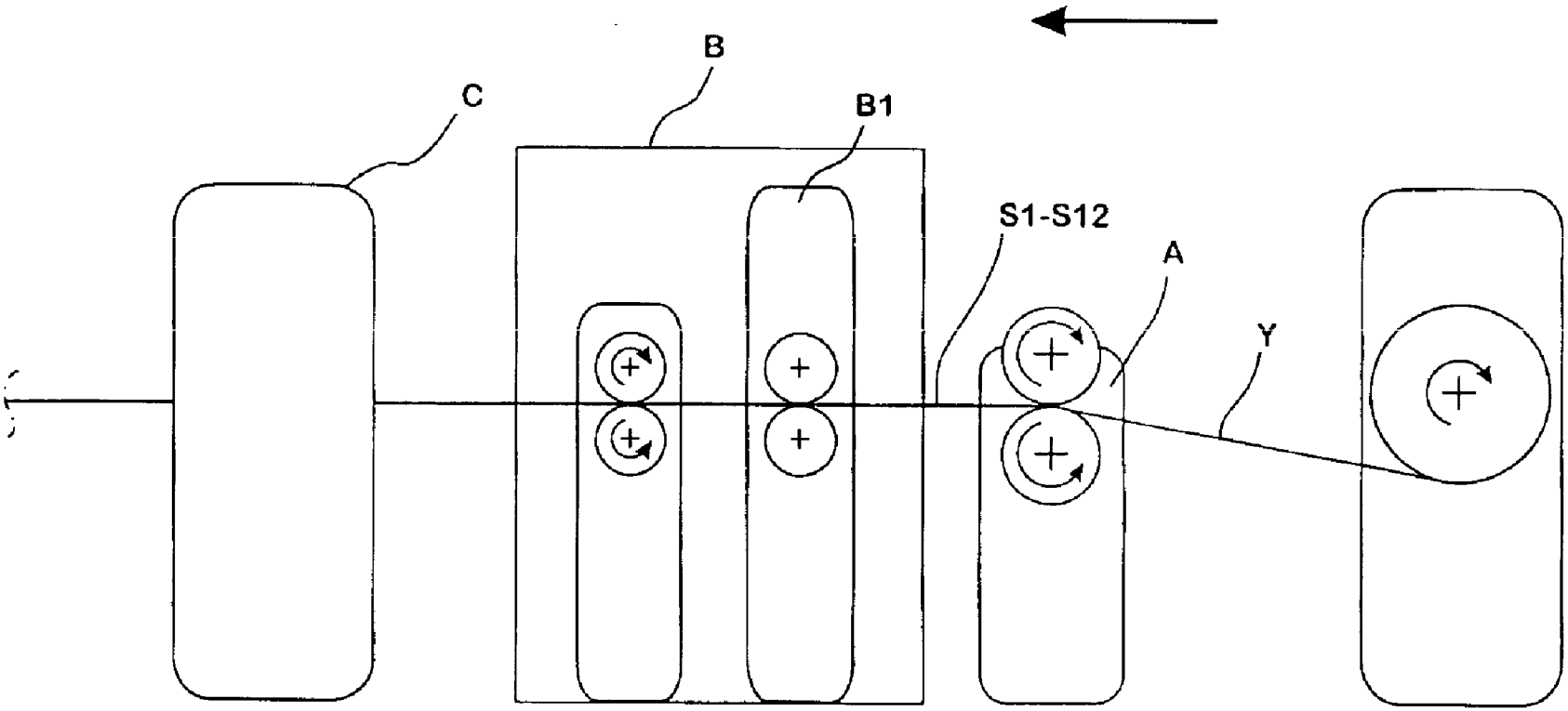
FIG. 3 shows a device for slitting a band, a device for transporting the strips, a device for isolating the strips and a device for further processing of the strips.

FIG. 3 shows a device A for slitting a band Y, a device B for transporting the strips S1–S12 from the device A, a device B1 to isolate the strips S1–S12 and a device C in which further processing of the strips S1–S12 takes place.

Separating unit N illustrated in the figures, which is made of two shafts 1, 2, is a part of a further device, not shown, for horizontal isolating of strips S1–S12, which are produced by slitting a steel band, not shown, in slitting shears, also not shown.

The device for isolating strips S1–S12 is, for example, positioned in the outlet of the slitting shears.

Alternatively, it may also be positioned on a transfer device, not shown. Using such a device, the front ends of strips S1–S12 may be transferred into a coiling device, not shown, in which they are wound into coils. The advantage of this design is that the time necessary for the transfer may be used for separating strips S1–S12.

Figure 1:
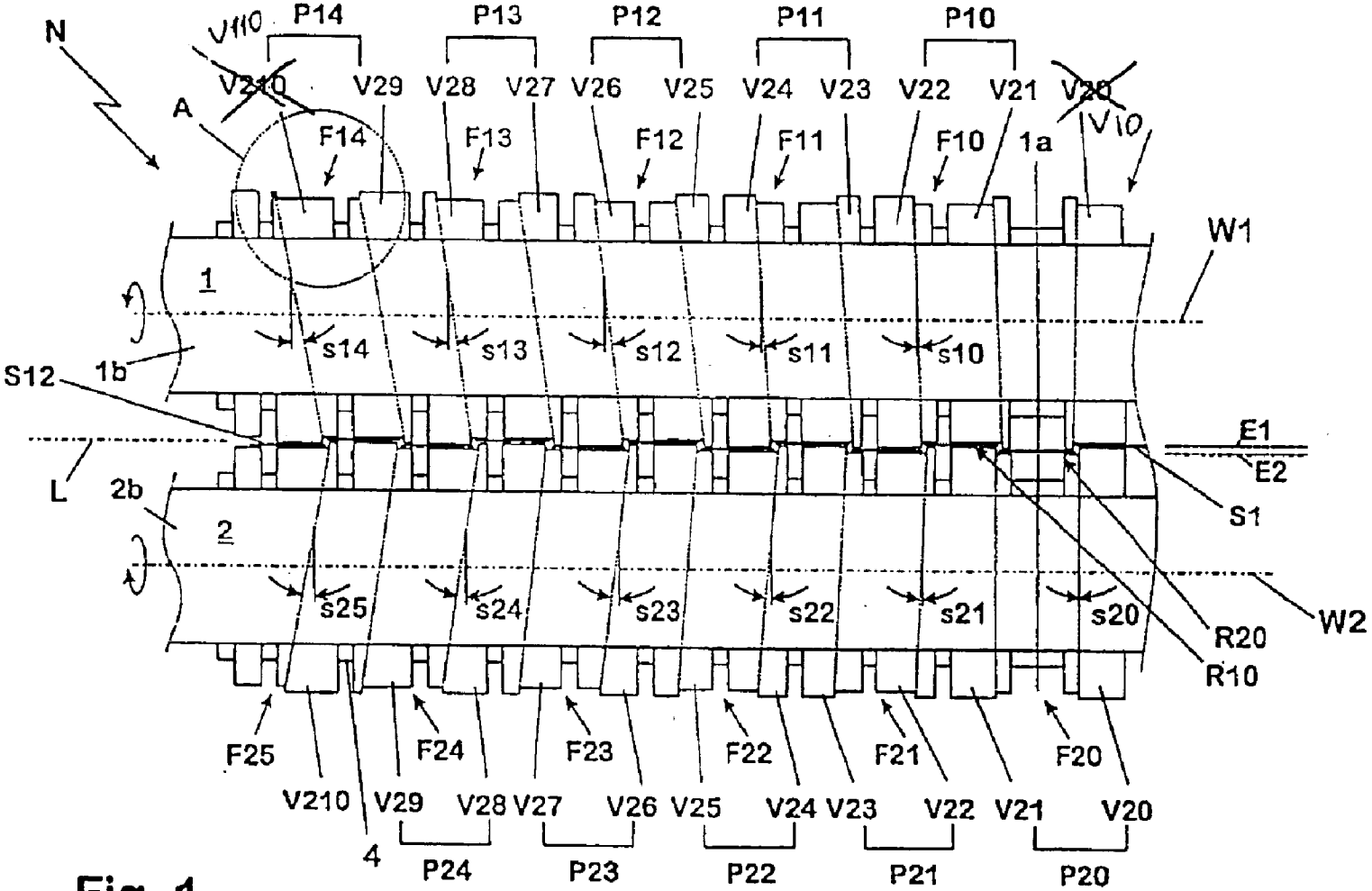
FIG. 1 shows, in a frontal partial view, a pair of shaft used in a device for isolating metal strips in a first operating position.
Figure 2:
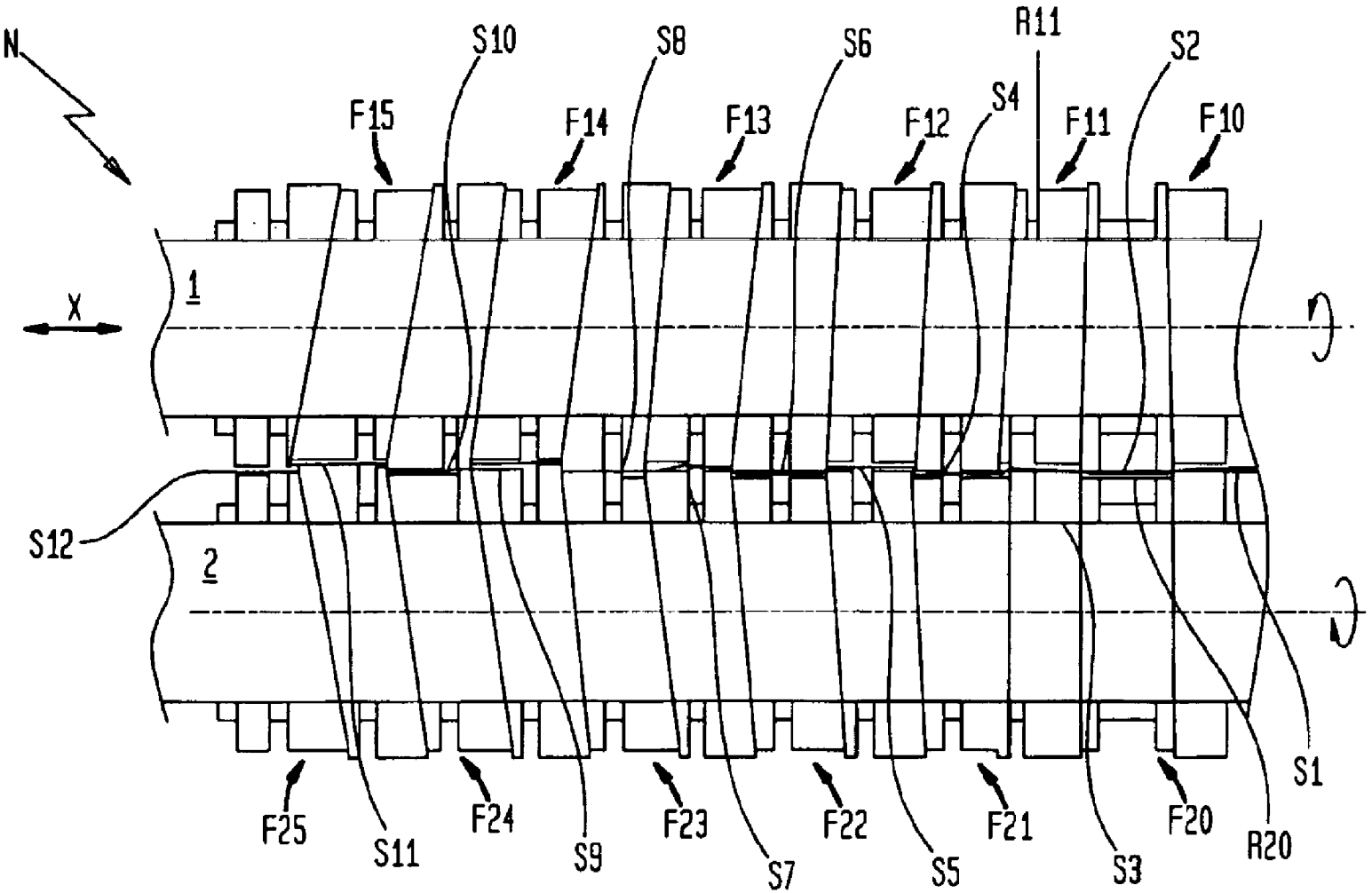
FIG. 2 shows, in a frontal partial view, the pair of shafts shown in FIG. 1 in a second operating position.

Each of shafts 1, 2 is equipped on one half, shown in FIGS. 1, 2, with isolating segments V10–V110 and/or V20–V210, which are pushed onto respective shaft 1 or 2 in succession in axial direction X and are connected to appropriate shaft 1, 2 via suitable attachment elements, not shown, so they are removable and rotate with the shaft. The interval in axial direction X between individual isolating segments V10–V110 and/or V20–V210 is fixed in this case by spacers 3, 4. A corresponding number of isolating segments V10–V110 and/or V20–V210, not shown, is positioned in the same way on the other half of shafts 1, 2.

The advantage of equipping shafts 1, 2 using isolating elements V10–V110 and/or V20–V210 in the way described, using spacers 3, 4, is that isolating elements V10–V110 and/or V20–V210 of the type may be precisely premanufactured as independent components at low cost and manually or automatically attached to shafts 1, 2 according to the current strip program. In this case, it is particularly advantageous if isolating segments V10–V110 and/or V20–V210 are removably connected to shaft 1, 2. This allows separating unit N to be adjusted to changed widths of strips S1–S12 within a short time. The latter particularly applies because, due to the removable attachment, the interval of isolating elements V10–V110 and/or V20–V210 may be adjusted easily. If the respective distance between isolating elements V10–V110 and/or V20–V210 is fixed by spacers 3, 4, it is also ensured that, even in the event of the occurrence of high lateral guide forces in the course of the separation, reliable, exactly positioned isolation of the strips S1–S12 is performed.

Each isolating segment V10–V110 and/or V20–V210 has a first radial circumferential contact surface 5, which is delimited on one side by a free radial circumferential edge 6 of respective isolating segment V10–V110 and/or V20–V210. In this case, isolating segments V10–V110 and/or V20–V210 are each positioned in pairs P10–P14 and/or P20–P24 in such a way that free edges 6, which laterally delimit first contact surfaces 5 of isolating segments V10–V110 and/or V20–V210 assigned to respective pair P10–P14 and/or P20–P24, are assigned to one another.

On its other side, first contact surface 5 of isolating segments V10–V110 and/or V20–V210 is delimited by a lateral wall 7 of a circumferential collar 8. In this case, in each of pairs P10–P14 and/or P20–P24, lateral walls 7 of isolating segments V10–V110 and/or V20–V210 assigned to respective pair P10–P14 and/or P20–P24 lie opposite to one another and have a parallel course implemented like a screw thread, lateral walls 7 of isolating segments V20–V210 assigned to shaft 2 being implemented in the opposite direction to lateral walls 7 of isolating segments V10–V110 assigned to first shaft 1.

In this way, lateral walls 7 and first contact surfaces 5 of isolating segments V10–V110 and/or V20–V210, which are each assigned to one of pairs P10–P14 and/or P20–P24, each form a guide F10–F14 and/or F20–F25, each of which has its own pitch s10–s14 and/or s20–s25, which differentiates it from each other pitch s10–s14 and/or s20–s25 of respective other guides F10–F14 and/or F20–F25.

In the region of collar 8, isolating segments V10–V110 and/or V20–V210 has a diameter D1, which is greater than diameter D2 of isolating segments V10–V110 and/or V20–V210 in the region of first contact surface 5. The circumferential surface of collar 8 forms a second radial circumferential contact surface 9, through which respective strip S1–S12 is held in guide F10–F14 and/or F20–F25 implemented on respective opposing shaft 1 and/or 2.

In this way, strips S1–S12 are guided between shafts 1, 2 in alternating succession in conveyor gaps R10, R20 in two planes of conveyance E1, E2, which run parallel to rotational axes W1, W2 of shafts 1, 2 and lengthwise axis L of separating unit N, which also runs parallel to these rotational axes W1, W2. In this case, guides F10–F14 of shaft 1 guide strips S1, S3, S5, S7, S9, S11 assigned to plane of conveyance E1, while guides F20–F25 guide strips S2, S4, S6, S8, S10, S12, which are assigned to second plane of conveyance E2.

Figure 1A:
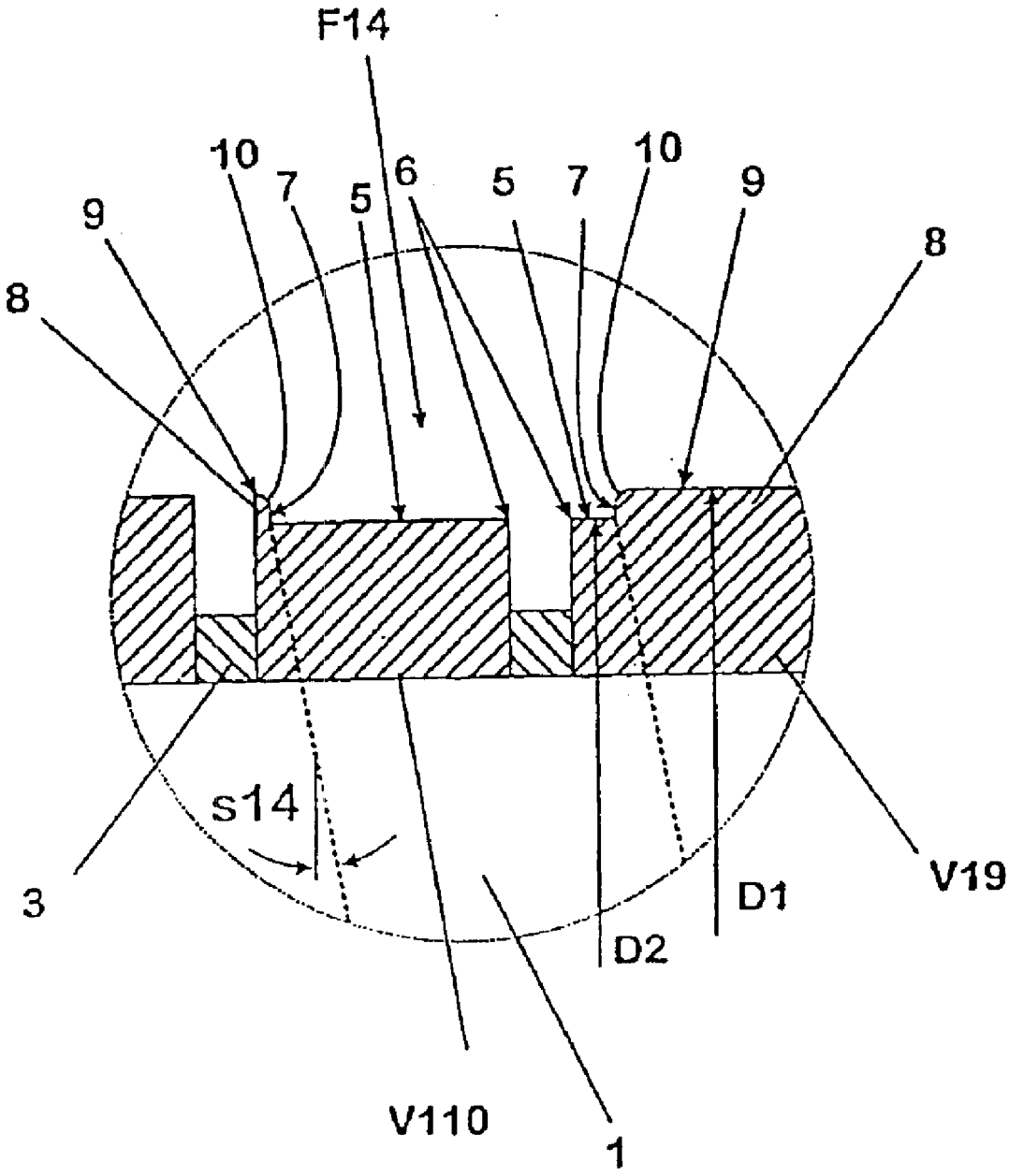
FIG. 1*a* shows, in a frontal partial view, an enlarged detail A of FIG. 1.

Free edge 10 between each lateral wall 7 and contact surfaces 9 assigned to this wall 7 is provided with a phase in the form of a flattening (FIG. 1*a*). This prevents the free edge, which would otherwise be sharp, from cutting into respective strips S1–S12 due to the lateral forces applied in the course of the separating procedure.

Pitches s10–s14 and/or s20–s25 of guides F10–F14 and/or F20–F25 increase, starting from guide F10 and/or F20 positioned closest to shaft center 1*a* of shafts 1, 2, in the direction of respective shaft end 1*b*, 2*b*. Thus, for example, guide F11 has a smaller pitch s11 than guide F12, positioned closest neighboring to it in the direction of shaft end 1*b*. In the same way, pitch s21 of guide F21 is larger than pitch s20 of guide F20, which is its closest neighbor in the direction of shaft center 1*a*. Simultaneously, pitch s20 of guide F20 is smaller than pitch s10 of guide F10 of shaft 1, which is positioned nearer shaft end 1*b*, which in turn is smaller than pitch s21 of next following guide F21 of shaft 2 in the direction of shaft end 1*b*, etc. The amount by which pitches s10–s14 and/or s20–s25 of guides F10–F25 each increase in relation to respective next smaller pitches s10–s14 and/or s20–s25 is uniform. In this case, the increase of the thread pitch of individual guides F10–F25 in relation to respective closest neighboring guide F10–F25 is selected in such a way that, starting from the initial position, the desired interval between strips S1–S12 is achieved in the separated position at maximum rotational setting of shafts 1, 2.

Shafts 1, 2 are rotatably mounted in opposite directions in bearings, not shown, for this purpose and may be transferred, using a drive, also not shown, from their first operating position, illustrated in FIG. 1, in which strips S1–S12 are not isolated, into the second operating position, shown in FIG. 2, in which strips S1–S12 are located in their separated position. In this case, the direction and speed of rotation of shafts 1, 2 during the separating procedure is tailored to the direction and speed of conveyance of strips S1–S12, so that the relative speeds arising are reduced to a minimum.

Using drives, also not shown, shafts 1, 2 may be moved away from one another in the radial direction for insertion of the front ends of strips S1–S12. Their axial interval may also be changed in such a way that strips S1–S12 are clamped in guide gaps R10, R20.

If shaft 1 is moved into an open position, not shown, the front ends of strips S1–S12 coming out of the slitting shears are automatically directed onto contact surfaces 5, 9 assigned to guides F10–F25 of second shaft 2, which is positioned below first shaft 1. Subsequently, shaft 1 is lowered so that the operating position illustrated in FIG. 1 is reached. In this position, strips S1–S12 are positioned in respective guides F10–F25 assigned to them.

Shafts 1, 2 are then rotated in opposite directions. Accompanying this rotation, respective strips S1–S12 are moved in the direction of shaft ends 1*b*, 2*b* in correspondence with pitch s10–s14 and/or s20–s25 of respective guide F10–F14 and/or F20–F25, starting from strip S1 assigned to shaft center 1*a*. At the end of the rotational movement, they are at uniform intervals in their separated positions (FIG. 2). In this case, the interval actually reached between strips S1–S12 in the separating position is dependent on the size of the rotational angle covered during the rotation of shafts 1, 2.

As an alternative to introducing the strip front ends when upper shaft 1 is raised, the front ends of strips S1–S12 may also be automatically pushed into guide gaps R10, R20 between shafts 1, 2.

Of course, it is also not absolutely necessary to drive shafts 1, 2 in opposite directions, as described in the example above. In an appropriate embodiment of guides F10–F25, shafts 1, 2 may also be driven in the same direction.

Clamping the strip front ends in guide gaps R10, R20 during or after the separating procedure may be expedient if separating unit N supplies the strip front ends to further processing after the insertion and separating.

List of Reference Numbers

1, 2 shafts
1*a* shaft center
1*b*, 2*b* shaft ends
3, 4 spacer
5 contact surface
6 edge
7 wall
8 collar
9 contact surface
D1 diameter
D2 diameter
E1, E2 planes of conveyance
F10–F14, F20–F25 guide
L lengthwise axis of the separating unit
N separating unit
P10–P14, P20–P24 pairs
R10, R20 conveyor gaps
S1–S12 strips
s10–s14, s20–s25 pitches
V10–V110, V20–V210 isolating segments
W1, W2 rotational axes of shafts 1, 2
X axial direction

What is claimed is:

1. A device for isolating strips conveyed next one another in their lengthwise direction, said device comprising:

at least one separating unit having a lengthwise axis, the separating unit having a plurality of guides, wherein each strip is assigned to one guide, and wherein each of said strips is inserted into said guides and is guided by said guides in a plane running essentially parallel to the lengthwise axis of the separating unit, wherein said plane is different for neighboring guides and wherein when the strips are inserted into the guides, the guides are adjustable from a starting position, in which the strips have a slight lateral interval, into a separating position, in which a larger lateral interval exists between the strips.

2. A device according to claim 1, wherein said strips are metal strips.

3. A device according to claim 1, wherein the planes in which the strips are guided comprise a first plane and a second plane, wherein the strips are guided in each of said first plane and second plane, and each strip being assigned to one guide is guided in one of said first and second planes, while each strip assigned to the closest neighboring guide parallel to the lengthwise axis of the separating unit is guided in the other of said first plane and second plane.

4. A device according to claim 1, wherein the separating unit includes two rotatably mounted shafts with parallel axes, wherein the strips are guided between said two rotatably mounted shafts, and the guides for the strips are positioned on the respective shafts and run around the circumference of the shafts.

5. A device according to claim 4, wherein the guides comprise thread sections, each said thread sections having a pitch and the movable shafts being driven in opposite directions with respect to each other.

6. A device according to claim 5, wherein starting from a first guide having the smallest pitch, the pitch of each following guide in the lengthwise direction away from the movable shafts is greater than the pitch of the closest neighboring guide in direction of the first guide.

7. A device according to claim 5 wherein the free edges are flattened or rounded at an angle tailored to the pitch of the thread section in such a way that an essentially exclusively linear contact occurs between the free edges and respective strips.

8. A device according to claim 1, wherein the guides of the separating unit comprise isolating segments.

9. A device according to claim 8, wherein the isolating segments are movably guided sliding blocks in the lengthwise direction of the separating unit.

10. A device according to claim 1, wherein the separating unit comprises a first operating position and a second operating position, wherein when the separating unit is in the first operating position the strips lie loosely in their guides, and when the separating unit is in the second separating position the strips are clamped in their guides.

11. A device according to claim 1, wherein the guides comprise free edges, said free edges being flattened or rounded at least when coming in contact with the strips.

12. A device for slitting a band into multiple strips conveyed next to another in the lengthwise direction, said device for slitting a band being positioned upstream of a device for isolating the strips, and said device for isolating the strips comprising at least one separating unit having a lengthwise axis, the separating unit having a plurality of guides, wherein each strip is assigned to one guide, and wherein each of said strips is inserted into said guides and is guided by said guides in a plane running essentially parallel to the lengthwise axis of the separating unit, wherein said plane is different for neighboring guides and wherein when the strips are inserted into the guides, the guides are adjustable from a starting position, in which the strips have a slight lateral interval, into a separating position, in which a larger lateral interval exists between the strips.

13. A device according to claim 12, wherein said band is a metal band.

14. A device according to claim 12, wherein the device for isolating the strips comprises a transfer position and an isolating position, wherein the strips to be isolated are accepted during the transfer position and the isolation of the strips occurs during the isolating position.

15. A device according to claim 12, further comprising a device for transporting the strips from the slitting device to a device for further processing the strips.

16. A device according to claim 15, wherein said strips are metal strips.

* * * * *